United States Patent [19]

van Ouwerkerk

[11] 4,436,032

[45] Mar. 13, 1984

[54] ROTARY SCREEN PRINTING APPARATUS

[75] Inventor: Wouter C. van Ouwerkerk, Hengelo, Fed. Rep. of Germany

[73] Assignee: Saueressig GmbH, Ahaus-Wüllen, Fed. Rep. of Germany

[21] Appl. No.: 340,833

[22] Filed: Jan. 19, 1982

[30] Foreign Application Priority Data

Jan. 21, 1981 [DE] Fed. Rep. of Germany ..... 3101766

[51] Int. Cl.[3] ..... B41L 41/00; B41L 13/18

[52] U.S. Cl. ..... 101/120; 101/425

[58] Field of Search ..... 101/120, 425

[56] References Cited

U.S. PATENT DOCUMENTS

| | | | |
|---|---|---|---|
| 973,520 | 10/1910 | Laffitte | 101/120 |
| 1,185,668 | 6/1916 | Hoc | 101/425 |
| 2,821,913 | 2/1958 | Johnson | 101/425 |
| 3,398,680 | 8/1968 | Moskowitz | 101/115 |
| 3,557,690 | 1/1971 | Voegelin | 101/120 |
| 3,658,003 | 4/1972 | Johnson | 101/425 |
| 3,800,702 | 4/1974 | Roberts | 101/425 |
| 3,886,861 | 6/1975 | Anselrode | 101/123 |
| 3,896,730 | 7/1975 | Garrett | 101/425 |
| 3,986,450 | 10/1976 | Zimmer | 101/425 |
| 4,103,615 | 8/1978 | Cruz | 101/120 |

FOREIGN PATENT DOCUMENTS

| | | | |
|---|---|---|---|
| 2040567 | 2/1971 | Fed. Rep. of Germany | 101/119 |
| 2341136 | 2/1974 | Fed. Rep. of Germany | 101/425 |
| 2444764 | 4/1975 | Fed. Rep. of Germany | 101/425 |
| 2939853 | 4/1981 | Fed. Rep. of Germany | 101/120 |
| 1324966 | 7/1973 | United Kingdom | 101/120 |

*Primary Examiner*—Clyde I. Coughenour

*Attorney, Agent, or Firm*—Becker & Becker, Inc.

[57] ABSTRACT

A rotary screen printing apparatus with at least one circular screen, one wiper, and one pipe for supplying the dye or color to the respectively lowermost segment of the inner side of the screen and over the width thereof, with the web of material being guided at an incline or vertically, and with the wiper device, when viewed in the direction of rotation of the screen, being spaced from and arranged after the supply pipe for the dye. Discharge openings of the supply pipe for the dye are distributed over the length of the pipe, which is arranged directly over the inner side of the screen, and is selectively connectible with a dye conveyor or a dye withdrawal pump. Alternatively, a separate withdrawal pipe may be provided for withdrawing excess dye.

11 Claims, 5 Drawing Figures

Fig. 2
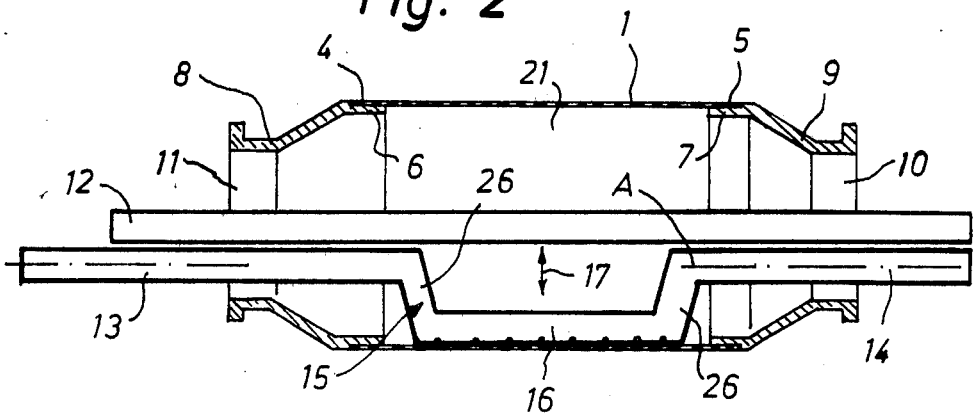
Fig. 4
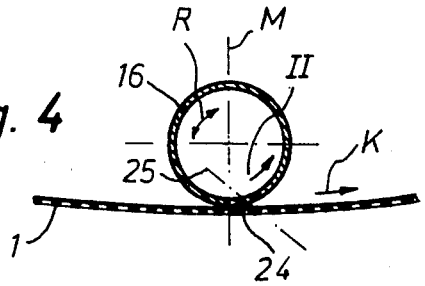
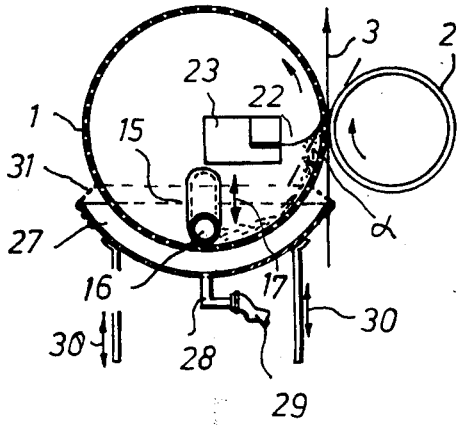
Fig. 3

ROTARY SCREEN PRINTING APPARATUS

The present invention relates to a rotary screen printing apparatus having at least one circular screen, one wiper device, and one pipe for supplying the dye or color to the respectively lower segment of the inner side of the screen and over the width thereof, with the web of material being guided at an incline or vertically, and with the wiper device, when viewed in the direction of rotation of the screen, being spaced from and arranged ahead of the supply pipe for the dye.

A method and apparatus for dyeing or printing webs of material, chiefly napped or piled material, on screen printing machines, especially rotary screen printing machines, is known from German Offenlegungsschift No. 22 59 225. An apparatus is utilized according to which a dye trough is arranged in the inner chamber of the circular screen; the opening of the trough provides the respectively lower segment of the inner side of the circular screen with dye. According to other known devices of this type, the walls of the dye vat can be provided with lip seals (German Offenlegungsschrift No. 22 50 092), or with a roller wiper. The arrangement of wiper devices for skimming or scraping-off and equalizing or levelling dye along the inner side of circular screens of screen printing machines is sufficiently known.

In contrast to the known rotary screen printing apparatus, it is an object of the present invention to be able to undertake dye change without dismantling the circular screen, thus avoiding damage to the sensitive circular screen. Despite avoiding dismantling of the circular screen, the dye change is to be undertaken in a short time and without great expenditure of energy. This is especially meaningful with small outfits. Finally, dye losses during dye change are to be reduced compared with known methods and apparatus; i.e., the amount of dye to be removed from the screen is to be reduced and recovered. Additionally, an undesired passing of the dye through the screen is to be avoided during standstill of the circular screen. All of the foregoing is to occur with technically simple means.

These objects, and other objects and advantages of the present invention, will appear more clearly from the following specification in connection with the accompanying drawings, in which:

FIG. 1 schematically illustrates vertical guiding of a strand or web of material, including several printing plates or screens located one above the other in the direction of movement of the material; also shown are the associated pressure rollers;

FIG. 2 is a vertical section through a circular plate or screen, including mounting thereof;

FIG. 3 is an enlarged cross section of a further embodiment of an apparatus in accordance with the present invention;

FIG. 4 shows a feed or supply pipe of the apparatus; and

Figure 1:
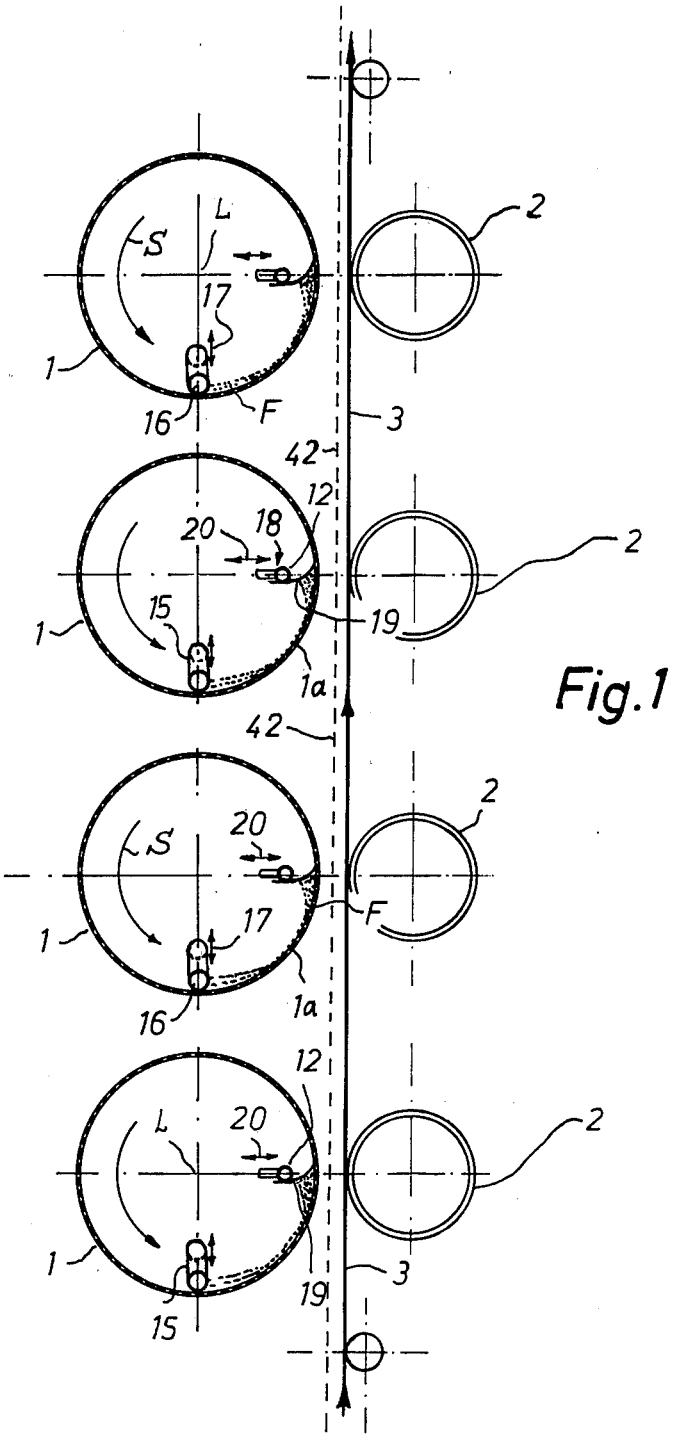

The apparatus of the present invention is characterized primarily in that the discharge openings of the supply pipe for the dye are distributed over the length of the pipe; the pipe is arranged directly over the inner side of the screen, and is selectively connectible with a dye conveyer or a dye withdrawal pump.

The apparatus of the present invention may also be characterized in that a withdrawal pipe is arranged directly over and at a slight distance from the inner side of the screen, or shortly before a wiper device located in or approximately in the horizontal central plane of the apparatus.

The following features describe improvements and further developments of the teaching of the present invention.

The wiper device, the single supply and withdrawal pipe, or the separate supply pipe and withdrawal pipe, may be radially adjustable relative to the scrreen independently of each other.

The single supply and withdrawal pipe, or the separate supply pipe and withdrawal pipe, may have discharge and withdrawal apertures which, when viewed in the direction of rotation of the circular screen, are inclined to the vertical and are located after the central plane of the associated pipe.

The single dye supply and withdrawal pipe, or the separate supply and withdrawal pipe, may be rotatable about their longitudinal axes.

The single dye supply and withdrawal pipe, or the separate supply and withdrawal pipe, may be pivotable about the longitudinal axis of the circular screen.

The single dye supply and withdrawal pipe, or the separate supply pipe or withdrawal pipe, which are connectible to a conveying and withdrawal pump, are connectible to a source of washing liquid.

A separate pipe may supply washing liquid into the interior of the screen.

The wiper device may be embodied as a pipe for supplying washing liquid, or any support such a pipe.

A removable apron, protective draping, or the like may be lowerable and liftable between the printing screen and the pressure roller located at the same level, or between the screen and the web of material resting on said pressure roller.

The separate dye supply pipe may be connected to a conduit for drawing off washing liquid.

The separate dye withdrawal pipe, which, when viewed in the direction of rotation of the screen, is arranged shortly before the wiper device, may be connected with a conduit for supplying washing liquid.

German Offenlegungsschrift No. 17 85 299, corresponding to U.S. Pat. No. 3,557,690-Voegelin dated Jan. 26, 1981, discloses a rotary film or screen printing machine according to which the wiper device is pivotally mounted in such a manner that the wiper blade, in addition to the known vertical dornwardly directed position, can also be brought into every other position along the inner periphery of the screen stencil. This adjustability is supported to serve the purpose upon termination of the printing procedure of avoiding a passing through of the dye ahead of the wiper through the perforations of the circular screen, and hence a contamination of the material, or at least of the printing blanket or of the pressure roller. To this extent, the individual feature that the wiper occupies a position divergent from the vertical is not in itself being stressed.

German Offenlegungsschrift No. 20 11 743 discloses an apparatus for printing webs of material, especially textile webs of material, according to which a roller wiper is arranged at the respectively lowermost segment of the inner side of the circular screen. The roller wiper is provided with an absorbent cover in order to print especially napped or piled material, and hereby not to subject the sensitive circular screen to loading as occurs with a rolling procedure between a roller wiper and a web of material, as well as to attain a sufficiently deep penetration of the dye into the nap. This known apparatus accordingly provides no withdrawal of the dye after termination of the printing procedure, and thus, already on the basis of the object of the present invention, such prior disclosure cannot provide any suggestion to the expert or average man skilled in the art for recovering excess dye through the dye supply pipe.

The advantage of the inventive apparatus consists in that the inner side of the sensitive circular screen, without having to dismantle the screen during dye change, can be quickly cleaned as a result of the withdrawal of the dye which collects between the wiper and the pipe. A saving of dye is achieved as a result of the withdrawal, which dye otherwise is generally washed off or rinsed from the circular screen. With vertical or nearly vertical guidance of a web of material, horizontal or nearly horizontal arrangement of the wiper, as well as arrangement of the dye supply in the respectively lowermost segment of the circular screen, i.e. a combination which already as such is inventive, there is avoided in every situation an unintended penetration of the screen by dye during standstill of the screen, even if dye collects temporarily at the respectively deepest or lowermost segment of the circular screen, which dye is then withdrawn.

Referring now to the drawings in detail, in the embodiment of the apparatus according to FIG. 1, four screen printers having similar spaced apart circular plates or stencil screens 1 are arranged vertically one above the other. Pressers or pressure rollers 2 located at the same height or level associated with the screens 1. The strand or web of material 3 is guided vertically from below to the top between the pressure rollers and the circular screens. During the printing procedure, the web of material 3 rests against the circular screens in the direction of a vertical tangent.

As shown in FIG. 2, the edges 4,5 of each of the circular screens 1 rest on corresponding sections 6, 7 of side parts 8,9, and are held there, for example, by adhesive connection. The two side parts 8,9 have respective openings 10, 11 through which the wiper or squeegee bar 12 of a wiper device (described in greater detail below), and the segment 13, 14 of a dye or color supply pipe or tube 15 project. The middle segment 16 of this feed or supply pipe 15 rests against the deepest part of the circular screen 1, preferably directly against the inner side of the circular screen 1. The segment 16 of the pipe 15 is radially adjustable in the circular screen 1 in the direction of the double arrow 17, so that an accommodation of the position of the segment 16 of the supply pipe 15 to the circular screen 1 can be effected.

A wiper device 18 having a wiper bar 12 and a wiper or doctor blade 19 projects into the inner chamber 21 of the circular screen 1. The wiper device, or the wiper blade, is located in the horizontal central plane, and is displaced by approximately 90° relative to the segment 16 of the dye or fluid supply pipe 15. The wiper device 18 can be shifted horizontally in the direction of the double arrow 20. With the embodiment according to FIG. 3, the wiper blade 22 is adjustably arranged on a bar 23.

The lower portion of the segment 16 of the dye or color supply pipe 15 has apertures 24 which are directed in the direction of rotation (arrow K in FIG. 4) of the circular screen 1 (see central bore line 25). The apertures 24, when viewed in the direction of rotation of the screen 1, are located ahead of the vertical center line M of the pipe segment 16. In order to change the position of the apertures 24 relative to the screen 1, the pipe 15 can be rotated about its axis A.

The supply pipe 15 is connected not only to a dye or fluid supply pump, but also to a suction pump or to a combination unit, so that dye or color can be selectively supplied to the pipe 15 in a known manner, yet excess dye or color can be drawn off through the apertures 24. Consequently, during standstill of the printing screen 1, the quantity of dye or fluid initially held back by the wiper blade 19 or 22 drains or runs off along the screen segment 1*a* and, viewed in the direction of rotation, collects ahead of the pipe segment 16 of the pipe 15 having the apparatus 24. The induced draft assures that the dye or fluid forming to the apertures 24 is drawn off, so that hereby on the one hand a recovery of the dye to the supply pipe 15 occurs, and on the other hand, especially the segment 1*a* of the circular screen 1, is extensively freed of dye, and a penetration of the dye to the web of material is precluded.

The terminology "directly over the inner side of the screen" as a characterization of the position of the segment 16 of the pipe 15 is to be taken to mean that this segment 16 is in a position continuously to draw off the excess quantity of dye with the induced draft, i.e., continuously to withdraw the excess quantity of dye without having this withdrawal of dye being interrupted or terminated by the withdrawal of air.

The dye supply and withdrawal pipe 15, with its segment 16, is pivotable about the longitudinal central axis L of the circular screen 1 (FIG. 1).

Below the circular screen 1 there is arranged a collecting trough 27 into which passes the washing liquid, which is introduced through the segment 16 of the pipe 15 into the interior of the screen 1, together with the remainder of dye not drawn off through the pipe 15, and which can be withdrawn via a connecting piece 28 and a hose 29. The trough 27, into which excess dye can also drain during the printing procedure, is adjustable in height in the direction of the arrows 30, and has seals 31 along its edge for engaging the screen 1. A slight underpressure can be generated in the trough 27 in order to withdraw washing liquid from the interior of the screen without hereby deforming the screen 1 itself.

It is also possible to split up the dye supply and withdrawal pipe into a supply pipe and a separate withdrawal pipe. While the supply pipe can be spaced from the inner wall of the screen, for instance in the second quadrant II (FIG. 4), the withdrawal pipe is embodied and arranged like the pipe 15 having the segment 16. The withdrawal pipe is also rotatable and pivotable like the pipe 15. In this connection, the washing liquid can be brought via one of the two pipes into the interior of the screen.

With the apparatus according to the present invention, the wiper or doctor blade 22 has an angle of incidence $\alpha$, relative to the vertical, of less than 45°, preferably in a range of 10° to 30°. Furthermore, the wiper blade 22 is made as a spring element in a known manner, and rests with more or less great prestress against the inner side of the screen 1. As a result of this especially small angle of incidence of the wiper blade compared with known wiper blades, the dye is guided into the wedge-shaped area between the wiper blade 22 and the screen 1. Owing to the acute-angled wedge surface of the wiper blade, the dye is pressed through the screen 1, without requiring gravitation.

The vertical arrangement of the screens 1 and of the pressure rollers 2 makes it possible during dye change and washing of the screens 1 to introduce an apron or draping 42 between the screen 1 and the pressure rollers 2, or between the web of material 3 and the screen 1; this apron 42 can be lifted and lowered.

Since the dye supply and withdrawal pipe 15, and with a separate supply pipe and withdrawal pipe, one of these pipes, is connectible with a washing fluid supply line, there results in addition to the advantage of recovering excess dye, the great advantage of being able to wash the screen 1 in the installed state. With the embodiment according to FIGS. 1 through 4, the pipe 15 assumes the function of supplying dye, of withdrawing excess dye, and of supplying rinsing and washing water. A similar situation results with the utilization of a separate dye supply pipe and dye withdrawal pipe.

The washing liquid can also be conveyed through a separate pipe into the inner chamber; this pipe preferably has injection nozzles which are directed at the screen 1. The wiper bar can be embodied as a washing liquid supply pipe, or can support such a pipe.

Figure 5:
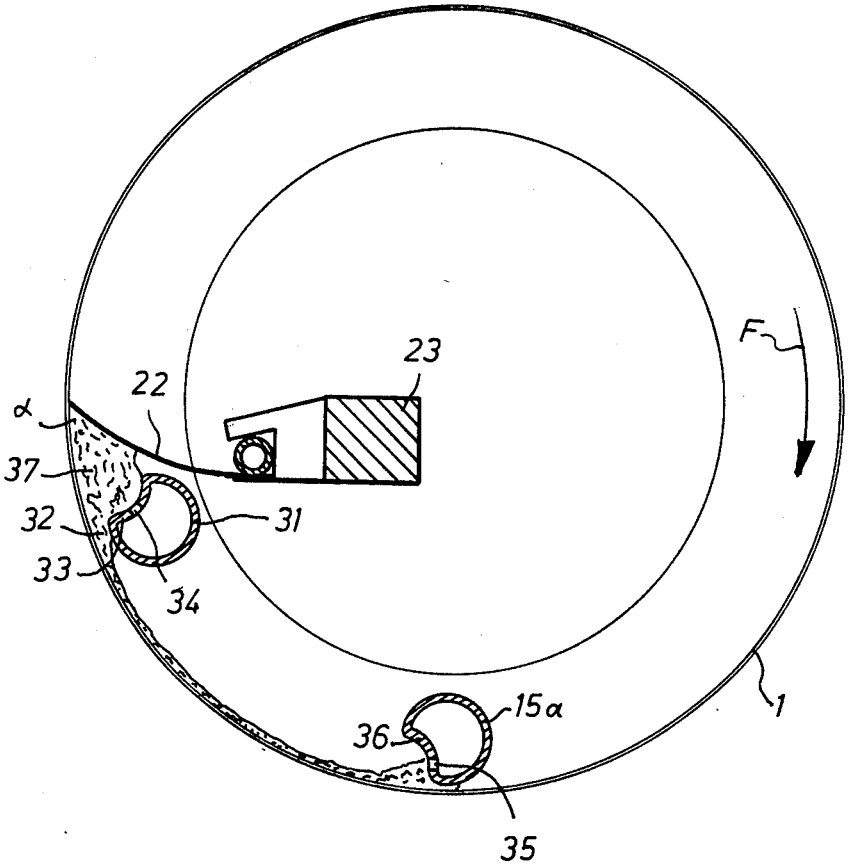
FIG. 5 shows a further embodiment in accordance with the present invention.

In the embodiment of FIG. 5, again a wiper bar 23 is provided with an approximately horizontal wiper blade or doctor blade 22. The angle of incidence of the wiper blade 22 against the inner wall of the screen 1, which rotates in the direction of the arrow F, is less than 45°. A withdrawal pipe 31, when viewed in the direction of rotation of the screen 1, is arranged shortly before the wiper blade 22; a small intermediate space 32 is left between the pipe 31 and the inner wall of the screen 1. Opposite the angle $\alpha$ between the wiper blade 22 and the screen 1, the withdrawal pipe 31 has a depression 33, in the middle of which a longitudinal slot or a row of holes 34 is provided. The dye or color supply pipe 15*a* is arranged approximately in the vertical central plane of the screen 1. The discharge slot or row of holes 35 of the dye supply pipe 15*a* is arranged in the depression 36 of the pipe. A trough corresponding to the trough 27 of FIG. 3 can be provided below the screen 1. The embodiment of the apparatus according to FIG. 5 offers the possibility, after withdrawal through the pipe 31 of the dye 37 which collects behind the wiper blade, of supplying the washing liquid through this pipe 31, for which purpose this pipe is connectible with a dye withdrawal device and with a conduit supplying washing liquid. The washing liquid can either be withdrawn through the screen 1 at the level of the trough, or the pipe 15*a* can serve as a withdrawal element for the washing liquid.

The present invention is, of course, in no way restricted to the specific disclosure of the specification and drawings, but also encompasses any modifications within the scope of the appended claims.

What I claim is:

1. A rotary screen printing apparatus for printing dye on a web of material, said apparatus having at least one cylindrical screen printer with a lower portion and an inner side for which dismantling is avoided to undertake dye change quickly at minimum cost while also minimizing any possible dye losses, which includes centrally therein:

supply and withdrawal means at the lower portion of said screen printer that selectively supplies or withdraws dye, said pipe means being connected to a source of dye for supplying dye over the width of that portion of the inner side of said screen printer which at any given time is the lower portion thereof, and also for withdrawing dye therefrom; said pipe means for supplying and withdrawing dye being provided with at least one aperture over its length being directed on the screen printer and arranged approximately in the immediate vicinity of the inner lower side of said screen printer and being selectively connectible with a dye conveying pump to supply dye and a dye withdrawal pump selectively to remove excess quantities of dye from said screen printer so that undesired passage of dye through the screen printer is avoided during standstill thereof; means for guiding a web material to be printed on vertically past said screen printer so that during the printing procedure the web of material engages tangentially against the screen printer and unwanted or unused dye reaching the web of material including any final dye residue, is drained and/or withdrawn from the lower inside portion of the screen printer to facilitate cleaning thereof; and a squeegee device which, when viewed in the direction of rotation of said screen printer, is spaced from said pipe means for supplying the dye that the squeegee device pushes through the screen printer and is positioned so that excess dye is accummulated between the squeegee device and the lower portion of said screen printer and drains or runs off along said screen printer for recovery therefrom via said pipe means.

2. An apparatus in combination according to claim 1, in which said pipe means for supplying and withdrawing dye comprises a common dye supply and withdrawal pipe which is provided with apertures over its length and is arranged directly over the inner side of the respectively lower portion of said screen printer.

3. An apparatus in combination according to claim 1, in which said squeegee device and said pipe means for supplying and withdrawing dye are radially adjustable relative to said screen printer independently of each other.

4. An apparatus in combination according to claim 1, in which said at least one aperture of said pipe means for supplying and withdrawing dye is inclined to the vertical and, when viewed in the direction of rotation of said screen printer, is located ahead of the central plane of said means for supplying and withdrawing dye.

5. An apparatus in combination according to claim 1, in which said pipe means for supplying and withdrawing dye is rotatable about its longitudinal axis.

6. An apparatus in combination according to claim 1, in which said pipe means for supplying and withdrawing dye is pivotable about the longitudinal axis of said screen printer.

7. An apparatus in combination according to claim 1, in which said pipe means for supplying and withdrawing dye is connectible to a source of washing liquid.

8. An apparatus in combination according to claim 1, which includes a separate pipe connected to a source of washing liquid for supplying washing liquid to the interior of said screen printer.

9. An apparatus in combination according to claim 1, in which said squeegee device is embodied as a pipe connected to a source of washing liquid for supplying washing liquid to the interior of said screen printer.

10. An apparatus in combination according to claim 1, in which said squeegee device supports a pipe connected to a source of washing liquid for supplying washing liquid to the interior of said screen printer.

11. An apparatus in combination according to claim 1, which includes cylindrical screens, for each screen printer, a pressure roller located at the same level, said web of material being guided vertically between associated circular screens and pressure rollers; and which includes a removable apron which is lowerable and raisable between said circular screens and said web of material.

* * * * *